United States Patent [19]

Georgiou et al.

[11] Patent Number: 4,618,972

[45] Date of Patent: Oct. 21, 1986

[54] X-RAY SOURCE COMPRISING DOUBLE-ANGLE CONICAL TARGET

[75] Inventors: George E. Georgiou, Gillette; Martin E. Poulsen, New Providence, both of N.J.

[73] Assignee: AT&T Bell Laboratories, Murray Hill, N.J.

[21] Appl. No.: 648,021

[22] Filed: Sep. 7, 1984

[51] Int. Cl.[4] ..... H01J 35/08

[52] U.S. Cl. ..... 378/34; 378/141; 378/143

[58] Field of Search ..... 378/143, 141, 34

[56] References Cited

U.S. PATENT DOCUMENTS

| | | | |
|---|---|---|---|
| 4,159,437 | 6/1979 | Sahores | 378/143 |
| 4,238,682 | 12/1980 | Vratny | 378/143 |
| 4,258,262 | 3/1981 | Maldonado | 250/419 |
| 4,439,870 | 3/1984 | Poulsen et al. | 378/143 |
| 4,455,504 | 6/1984 | Iversen | 378/141 |
| 4,477,921 | 10/1984 | Armini | 378/143 |
| 4,521,903 | 6/1985 | Braun | 378/143 |

OTHER PUBLICATIONS

*Technical Digest, IEDM,* 1980, "Scaling the Micron Barrier with X-rays", by M. P. Lepselter, p. 42.

*Journal Vacuum Science Technology,* vol. 16, 1979, "X-ray Lithography Source Using a Stationary Solid Pd Target", by J. R. Maldonado et al., p. 1942.

*Primary Examiner*—Craig E. Church

*Assistant Examiner*—T. N. Grigsby

*Attorney, Agent, or Firm*—Lucian C. Canepa

[57] ABSTRACT

An improved X-ray source for a lithographic system comprises a double-angle conical target. The target is characterized by a small apparent source diameter and an efficient cooling system. Submicron resolution and high-power operation are thereby made feasible.

13 Claims, 3 Drawing Figures

X-RAY SOURCE COMPRISING DOUBLE-ANGLE CONICAL TARGET

BACKGROUND OF THE INVENTION

The invention relates to the generation of X-rays and, more particularly, to an improved X-ray source characterized by a relatively small diameter and high power.

X-ray generators are utilized in a variety of applications of practical importance. One significant area in which such sources are employed is the field of X-ray lithography. An illustrative X-ray lithographic system utilized to make structures such as very-large-scale-integrated semiconductor devices is described in an article by M. P. Lepselter entitled "Scaling the Micron Barrier With X-Rays," *Technical Digest* 1980 *IEDM*, page 42. An advantageous water-cooled X-ray source for inclusion in such a system is specified by J. R. Maldonado, M. E. Poulsen, T. E. Saunders, F. Vratny and A. Zacharias in "X-Ray Lithography Source Using a Stationary Solid Pd Target," *Journal Vacuum Science Technology*, Volume 16, page 1942 (1979). Such a source is also described in U.S. Pat. No. 4,258,262.

In an X-ray lithographic system of the proximity printing type, it is well known that the magnitude of a so-called penumbra is deleteriously affected by the fact that the source of X-rays utilized to irradiate a mask in the system is in practice not an ideal point source but has instead a finite size. It is further known that increasing the penumbra decreases the resolution capabilities of the system.

Hence, as the drive towards a submicron (for example, ≦0.5 micrometers) capability for such an X-ray system continues, various approaches are being explored to decrease the size of the penumbra. One effective way of doing so is to reduce the diameter of the X-ray source included in the system.

Additionally, efforts have been directed by workers at trying to increase the power capabilities of X-ray sources. It was recognized that such efforts, if successful had the potential for decreasing the time required to expose resist-coated wafers in X-ray lithographic systems, thereby increasing the throughput characteristics thereof. Alternatively, in such a higher-power system, the penumbra can be reduced while throughput remains unaffected. This is done by increasing the X-ray source-to-wafer distance while at the same time increasing source power to maintain a constant exposure time.

SUMMARY OF THE INVENTION

Hence, an object of the present invention is an improved X-ray lithographic system capable of relatively high resolution. More specifically, an object of this invention is such a system having a relatively small-diameter X-ray source. Another object of the invention is an improved X-ray source capable of relatively high-power operation.

Briefly, these and other objects of the present invention are realized in a specific illustrative embodiment thereof that comprises an X-ray source having a double-angle hollow-cone target. The upper or apex portion of the target is designed to be impacted by incident electrons. The interior surface of this upper portion has steep walls characterized by a relatively small angle with respect to the main longitudinal axis of the target. The interior surface of the lower or base portion of the target is designed to have a larger angle. As a result, a sufficiently large opening is provided for the incident beam to enter the interior of the target without impacting the base portion thereof to any appreciable extent. At the same time, a relatively large-area region of the steeply inclined apex portion of the target is impacted to produce X-rays.

In embodiments of applicants' invention, the apex portion of the target is made of a material that emits specified X-rays of a desired wavelength tailored to match a particular X-ray resist to be selectively irradiated. But in one embodiment of the invention the base portion of the target can be made of a different material that emits X-rays that fall outside the sensitivity range of the resist. (Alternatively, the base material is selected to emit X-rays that do not propagate with low attenuation through the system.) In that way, even if the base portion is impacted to some extent by incident electrons, the resulting X-ray emission therefrom will not cause any substantial spurious irradiation of the resist.

BRIEF DESCRIPTION OF THE DRAWING

A complete understanding of the present invention and of the above and other features thereof may be gained from a consideration of the following detailed description presented hereinbelow in connection with the accompanying drawing, in which.

DETAILED DESCRIPTION

Figure 1:
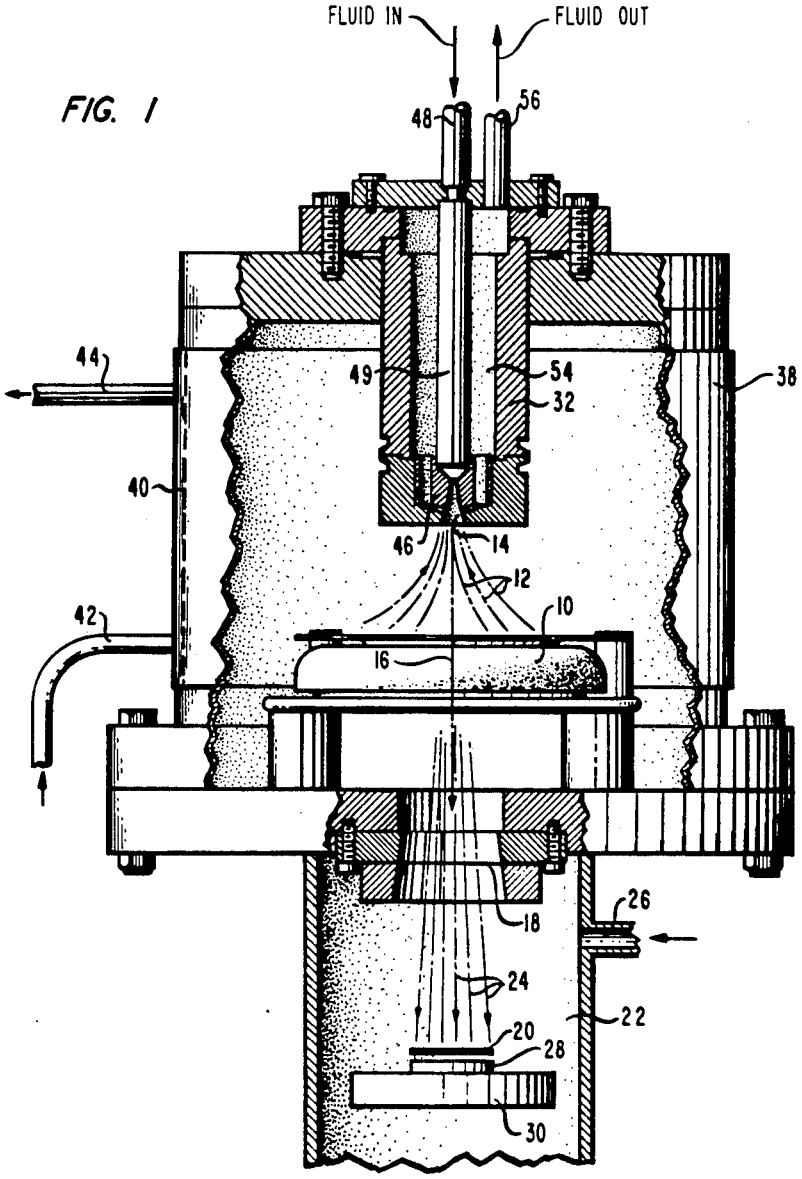
FIG. 1 is a schematic representation of a specific illustrative X-ray lithographic system that includes a source made in accordance with the principles of the present invention.

In a generalized schematic way, FIG. 1 of the drawing shows the major components of an X-ray lithographic system. An electron gun 10 accelerates a beam of electrons, designated by dot-dash lines 12, towards a portion of the inside surface of an anode made in accordance with the principles of the present invention. (The structure of the anode 14 will be described in detail later below in connection with FIG. 3.)

In response to bombardment by electrons, the anode 14 emits X-rays which propagate downwards in FIG. 1, centered about longitudinal axis 16, through a beryllium window 18 to irradiate the upper surface of a conventional X-ray mask member 20 mounted in a cylindrical exposure chamber 22. By way of a specific example, the chamber 22 is shown open at the bottom end thereof and, for example, contains therein a helium atmosphere at a pressure slightly in excess of atmospheric pressure. Helium gas is introduced into the chamber 22 via an inlet tube 26.

X-rays directed at the mask member 20 are designated by reference numeral 24. The mask is shown positioned in spaced-apart relationship with respect to a substrate 28, for example a wafer member, whose top surface is coated with a layer of a standard X-ray-sensitive resist material. In turn, the resist-coated substrate is mounted on a conventional work table 30.

The anode 14 shown in the drawing is mounted in a circular opening on the bottom of a cylinder 32 whose upper portion is secured to the upper surface of a cylindrical vacuum chamber 38. Illustratively, the pressure within the chamber 38 is maintained in the range of $10^{-9}$ to $10^{-8}$ Torr. Advantageously, the chamber 38 is constructed to include two spaced apart walls that form between them a cooling jacket 40. Cooling of the chamber 38 is accomplished, for example, simply by circulating tap water through the jacket 40 via respective inlet and outlet pipes 42 and 44.

The structure and operation of the electron gun 10 represented in FIG. 1 herein are described in detail in U.S. Pat. No. 4,258,262 of J. R. Maldonado. Illustratively, the gun 10 comprises an annular dispenser-type tungsten cathode. By way of example, the gun 10 bombards the anode 14 with 25 kilo-electron-volt electrons.

In addition, as described in the Maldonado patent, cooling of the anode 14 is carried out by directing a fluid such as water over the top surface of the anode in a precisely controlled manner. As described therein, this is done by positioning a so-called diverter 46 to encompass a portion of the anode 14. Fluid is delivered to the diverter by means of an inlet pipe 48.

Cooling fluid is directed downward over the top surface of the anode 14 of FIG. 1 via a tube 49 that constitutes an extension of the inlet pipe 48 within chamber 54. The bottom end of the tube 49 is designed to fit into a cylindrically shaped recess portion formed in the top of the diverter 46. Fluid directed through the diverter 46 then flows via an annular gap formed between the diverter and the bottom inside surface of the cylinder 32 upwards through multiple passageways formed in the diverter 46. The fluid then flows upwards through the main interior chamber 54 of the cylinder 32 and through an outlet pipe 56.

Further details concerning the diverter 46 and specific illustrative operating characteristics of the overall system represented in the drawing herein are contained in the aforecited Maldonado patent. As described therein, a substantially uniform and turbulent flow of water characterized by nucleate boiling is established in the immediate vicinity of the surface of the target anode to be cooled.

In one advantageous system design that includes the target anode 14 (FIG. 1), the X-ray wavelength chosen for resist exposure was the 4.36-Angstrom-unit palladium line. Available resist materials have high sensitivity to X-rays of this wavelenth. Additionally, as is known, this wavelength is short enough to allow exposure to be made in helium at atmospheric pressure and to allow the use of high-strength mask substrates.

Figure 2:
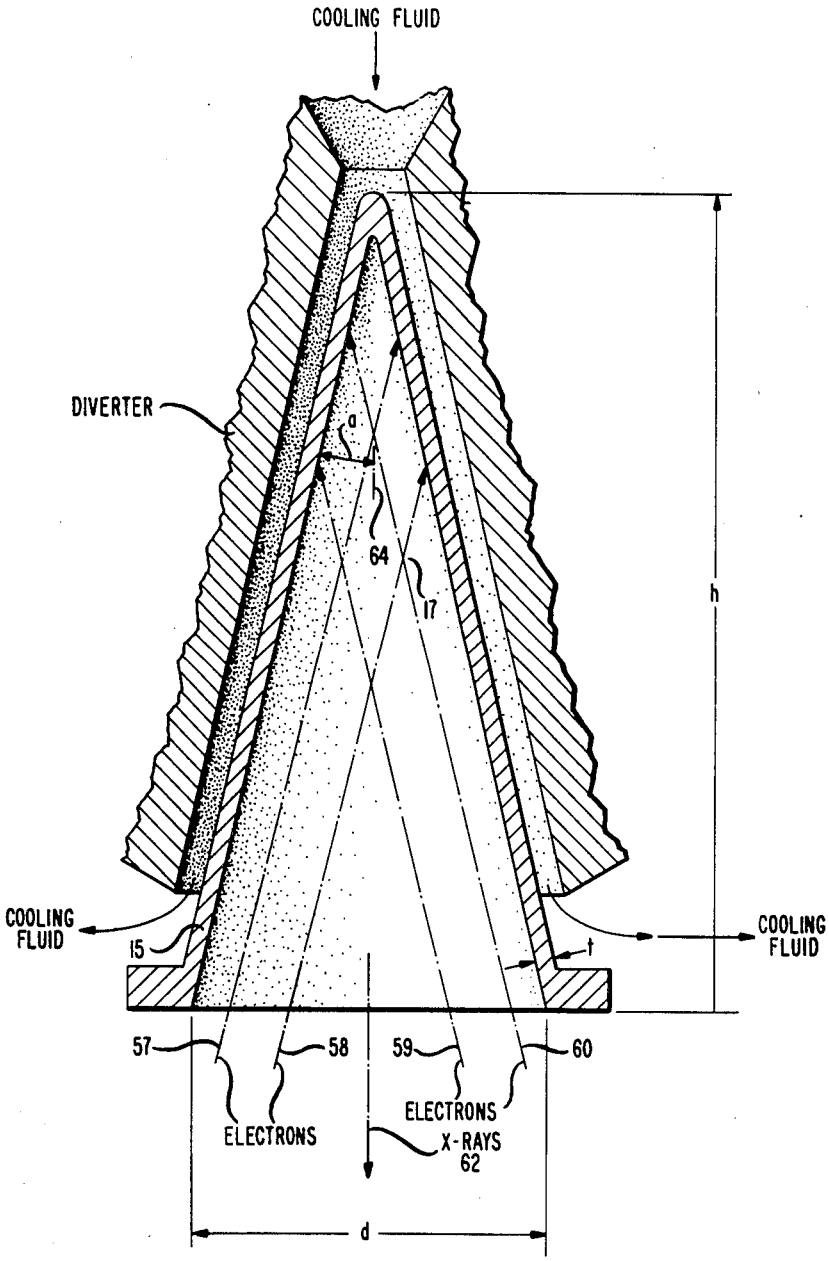
FIG. 2 (PRIOR ART)
FIG. 2 shows a standard conical target of the type priorly known.

A conventional stationary water-cooled target anode 15 is shown in FIG. 2. Illustratively, the anode 15 comprises a hollow cone made of pure or substantially pure palladium having a wall thickness t in the range of 200-to-350 micrometers. As indicated, an annular beam of electrons represented by arrows 57 through 60 enters the open or base portion of the conical anode 15 and impinges upon an annular inner-surface region to cause X-rays to be emitted therefrom. The emitted X-rays are propagated downward in FIG. 2 in the direction of arrow 62. From below, the X-ray source appears to be a "spot". In one illustrative case, the diameter of this apparent source is approximately 2 millimeters.

In the course of propagating upward inside the anode 15 of FIG. 2, the converging electron beam is characterized by a waist or cross-over region designated by reference numeral 17. After the waist 17, the beam diverges before impacting the inner surface of the anode 15.

As set forth in U.S. Pat. No. 4,439,870 of M. E. Poulsen, F. Vratny and A. Zacharias, it is important to avoid diffusion of hydrogen species into the outside or water-cooled surface of a palladium anode. To avoid such diffusion in the conventional anode 15 of FIG. 2 or in applicants' inventive anode shown in FIG. 3, a limited-depth hydrogen-barrier layer is advantageously formed within the anode extending from the outside surface thereof, as specified in detail in the aforecited U.S. Pat. No. 4,439,870.

In the standard conical anode 15 shown in FIG. 2, the entire inner surface of the base and apex portions thereof is disposed at the same angle with respect to longitudinal axis 64. In one such illustrative single-angle anode as heretofore made, the angle a (FIG. 2) was approximately 12.5 degrees. In that particular anode, the inner surface area of the annulus impacted by electrons was about 14.5 square millimeters. The apparent diameter of the resulting source of X-rays was approximately 2 millimeters. By way of example, the height h and the diameter d of the bottom opening of that particular anode were about 1.5 and 0.6 centimeters, respectively.

Figure 3:
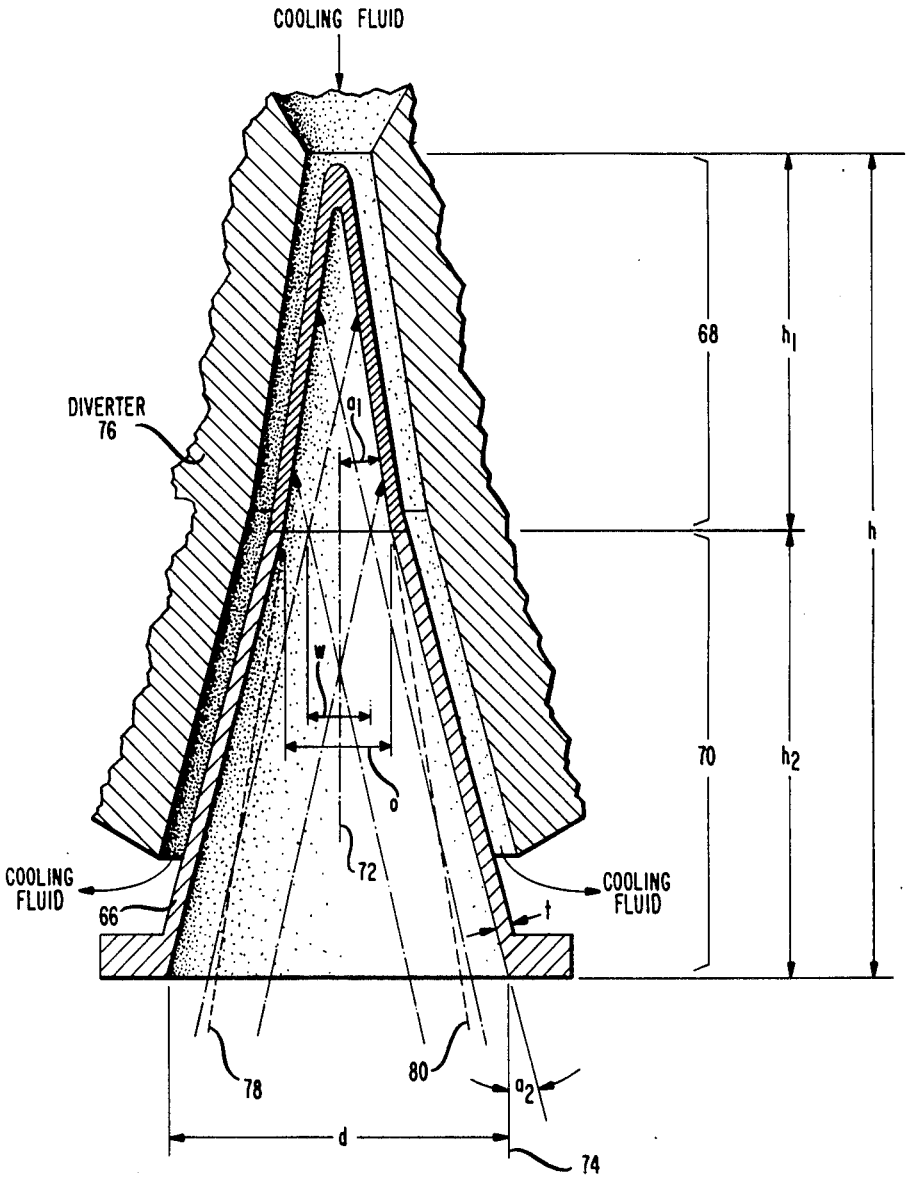
FIG. 3 depicts a specific illustrative double-angle conical target that embodies the principles of applicants' invention.

In a conical target anode of the FIG. 2 or FIG. 3 type, there are two regions that are relatively poorly cooled by the high-velocity fluid directed along the outer surface thereof. These poorly cooled surface regions are in the vicinity of the apex and of the base of the anode where the circulating fluid experiences turbulence due to abrupt changes in direction in the fluid passageways. Fluid in those regions is relatively stagnant and exhibits a relatively low velocity. Hence, any significant amount of electron-beam power falling on inner surfaces of the anode opposite the poorly cooled regions may induce boiling in those regions. In turn, vapor may collect in those regions and thereby impede the desired high-velocity fluid flow along the outer surface of the anode. As a consequence, poor overall cooling of the target may result and burn-out thereof may occur in the region where the main portion of the electron beam impinges.

As seen from FIG. 2, the main portion of the electron beam impacts the inner surface of the target anode 15 in a region that is relatively close to the aforementioned poorly cooled apex region. Accordingly, it is particularly important that the extent of this poorly cooled region from the apex of the anode be made as short as possible. In any case, the poorly cooled region must not overlap to any appreciable extent the beginning of the outer surface region that is directly opposite the region of maximum electron-beam impact. Otherwise, the probability of achieving high-power operation of such a target over extended periods of time is significantly diminished.

FIG. 3 shows a specific illustrative double-angle conical target anode 66 made in accordance with the principles of the present invention. The anode 66 includes an upper or apex portion 68 and a lower or base portion 70. The inner surface of the portion 68 is disposed at an angle $a_1$ with respect to longitudinal axis 72, and the inner surface of the portion 70 is disposed at an angle $a_2$ with respect to reference line 74 that is parallel to the axis 72. In accordance with the invention, the angle $a_1$ is less than the angle $a_2$. Moreover, the angle $a_1$ is typically less than the angle a of the standard anode shown in FIG. 2. Additionally, the angle $a_2$ of FIG. 3 is typically greater than the angle a shown in FIG. 2.

By way of example, the height h of the anode 66, the diameter d of the bottom opening thereof and the anode thickness t shown in FIG. 3 are the same as the corresponding dimensions of the anode 15 of FIG. 2. Illustratively, the height $h_1$ of the apex portion 68 (FIG. 3) is about 6.25 millimeters and the height $h_2$ of the base portion 70 is approximately 8.75 millimeters. Further, in one specific illustrative embodiment, $a_1$ is approximately 8.5 degrees and $a_2$ is about 15 degrees.

Advantageously, the anode 66 of FIG. 3 comprises palladium, with a limited-depth hydrogen-barrier layer, as described in the previously mentioned U.S. Pat. No. 4,439,870. Further, the system utilized to cool the invention anode 66 includes a diverter 76 similar to the diverters described in the aforecited U.S. Pat. No. 4,258,262 and shown in FIG. 2 herein.

Several significant advantages stem from the fact that the apex angle $a_1$ shown in FIG. 3 is relatively small. First, the extent of the change in direction in the fluid passageway of the diverter 76 in the immediate vicinity of the apex of the anode 66 is thereby reduced. As a result, the distance required along the outer surface of the anode for the perturbed flow to restabilize is also reduced. Thus, the high-velocity fluid flow is re-established and effective cooling resumed at a point that is relatively short distance from the apex of the anode 66. Consequently, the area of the apex portion of the anode that may be safely impacted by electrons is relatively large. In turn, this relaxes the constraints on and facilitates the overall design of a system that includes an anode of the type depicted in FIG. 3.

The fact that the inner surface of the apex portion of the anode 66 of FIG. 3 is relatively steep is the basis for other important advantages. Thus, for a specified input electron beam inclined at a given angle, the beam power per unit area of the impacted inner surface of the anode 66 is less than that of an anode with a less steep apex portion. (See, for example, the standard anode 15 depicted in FIG. 2) Illustratively, for the particular case wherein a (FIG. 2) is 12.5 degrees and $a_1$ (FIG. 3) is 8.5 degrees, the beam power per impacted unit area is less for the FIG. 3 structure by a factor determined by the ratio sin 17°:sin 25° or by approximately 0.7. Significantly, this translates into an increase of about 45 percent in the electron beam power that a given anode cooling system can handle. Accordingly, an improved high-throughput lithographic system exhibiting a long lifetime characteristic is thereby made feasible.

Another advantage of the relatively steeply inclined apex portion 68 (FIG. 3) is that the diameter of the apparent X-ray source is decreased compared to a larger-angle anode. Thus, again for the particular case wherein a (FIG. 2) is 12.5 degrees and $a_1$ (FIG. 3) is 8.5 degrees, the source diameter as viewed from below is reduced for the FIG. 3 structure by a factor approximately determined by the ratio tan 17°:tan 25° or about 0.7. Thus, a 2-millimeter-diameter source can be converted into a 1.4-millimeter-diameter source in an X-ray lithographic system simply by replacing the conventional anode 15 (FIG. 2) by applicants' inventive anode 66 (FIG. 3). Significantly, the penumbra is thereby reduced and the resolution capabilities of the system accordingly enhanced.

In practice, the maximum steepness of the inner surface of the apex portion 68 (FIG. 3) is determined by the configuration of the incident electron beam. More specifically, the diameter o of the opening at the base of the apex portion 68 must be at least as large as the diameter w of the electron beam at its waist or cross-over region.

The anode 66 shown in FIG. 3 cannot in practice simply consist of a relatively short apex portion 68 characterized by the steep angle $a_1$. This is so because the turbulent effects caused by the change in direction near the bottom of the associated diverter must occur sufficiently far away from the electron-impacted region of the anode to insure that reliable cooling in the impacted region is not significantly affected. In actual systems, the height h of the anode 66 must therefore be at least about 1.5 centimeters.

Additionally, the anode 66 (FIG. 3) cannot in practice simply consist of a relatively long apex portion 68 characterized by the angle $a_1$. The outline of the lower portion of such a steep single-angle anode is represented in FIG. 3 by dotted lines 78 and 80. As indicated, such a single-angle anode would not provide a sufficiently large opening at its base to allow the incident electron beam to enter the interior of the anode without impacting the base of the structure.

Thus, in accordance with the principles of the present invention, the lower or base portion 70 of the anode 66 shown in FIG. 3 is angled out sufficiently to allow the entirety of the incident electron beam to enter the anode without striking the base portion 70 to any appreciable extent. This minimizes the likelihood of burn-out of the anode, for the reasons discussed earlier above, and also insures that virtually all of the available incident electrons end up impacting the target region of interest in the apex portion 68.

In general, significant angling out of the opening of the base portion 70 (FIG. 3) beyond that needed to clear the incident electron beam should be avoided. This is so because as the angle $a_2$ increases substantially beyond that represented in the drawing, the amount of turbulence introduced in the cooling fluid flow also increases substantially. And this turbulence, if excessive, may in turn extend into and deleteriously affect the cooling action in the critical impacted region of the apex portion 68.

The electron beam shown in FIG. 3 is represented in idealized form. In practice, some electrons traverse paths outside the beam extents depicted in the drawing. Accordingly, even in the advantageous structure shown in FIG. 3, some electrons strike the inner surface of the base portion 70 and cause spurious X-rays to be emitted therefrom. In turn, these X-rays may irradiate portions of a resist-coated wafer that are not intended to be irradiated.

In accordance with a feature of the principles of the present invention, generation of the aforementioned spurious X-rays in a target anode can be eliminated or at least substantially reduced. This is done, for example, by making the base portion 70 of the anode 66 of FIG. 3 of a material that emits X-rays whose wavelengths lie outside the sensitivity ranges of typical X-ray resists or above the cutoff wavelength of the beryllium window 18 (FIG. 1).

Thus, by way of example, it is advantageous to make the base portion 70 (FIG. 3) out of nickel or a nickel-copper alloy such as Monel alloy. As before, the apex portion 68 remains, illustratively, made of palladium. Any spurious X-rays emitted from the base portion of such a composite anode are largely outside the sensitivity range of typical X-ray resists utilized in a palladium-based system.

To make such a composite anode characterized by low spurious emission of X-rays, the two different materials are, for example, first brazed or welded together in stock form. Then the two-material stock is machined in a conventional way to form a double-angle target of the type depicted in FIG. 3.

In summary, there has been described herein an advantageous X-ray lithographic system characterized by a unique and advantageous double-angle conical target electrode. The inclusion of such an electrode enhances the resolution capabilities and the throughput properties of such a system. Additionally, the availability of the double-angle electrode provides a basis for increased flexibility in the overall design of the system. Thus, the geometry of applicants' electrode can often in practice be tailored to optimally match the configuration of the beam provided by a particularly advantageous electron source. By contrast, with a single-angle electrode, the electron-beam-forming structure may be constrained by the geometry of the electrode to constitute a less-than-optimal design.

Finally, it is to be understood that the above-described arrangements are only illustrative of the principles of the present invention. In accordance with those principles, numerous modifications and alternatives may be derived by those skilled in the art without departing from the spirit and scope of the invention.

What is claimed is:

1. In combination in an X-ray system, a double-angle conical target that includes a conical apex portion including an inner surface region and a conical base portion including an inner surface region, the inner surface region of said apex portion being more steeply inclined than the inner surface region of said base portion, the inner surface region of said apex portion comprising an X-ray-emissive material for producing X-rays in response to electron bombardment of said inner surface region of said apex portion, means for directing substantially the entirety of a beam of electrons at the inner surface region of said apex portion, and means for directing cooling fluid along outer surface regions of said target.

2. A combination as in claim 1 wherein said electron directing means comprises an annular cathode.

3. A combination as in claim 2 wherein the inner surface region of said apex portion comprises palladium.

4. A combination as in claim 3 wherein said X-rays comprise the 4.36-Angstrom-unit palladium line.

5. A combination as in claim 4 wherein the inner surface regions of said apex and base portions are made of different materials.

6. A combination as in claim 5 wherein the inner surface region of said conical base portion is made of a material that in response to electron bombardment emits X-rays whose wavelength lies outside the sensitivity range of a resist coating to be irradiated.

7. A combination as in claim 5 wherein the inner surface of said conical base portion is made of a material that in response to electron bombardment emits X-rays whose wavelength lies above the cutoff wavelength of a beryllium window interposed between said target and said resist coating.

8. An X-ray lithographic system for irradiating a mask with X-rays, said system comprising a double-angle conical target electrode, means for directing a beam of electrons at an interior surface region of said electrode to produce X-ray emission therefrom, and means for cooling said electrode, wherein said electrode comprises a conical apex portion including said interior surface region and a conical base portion, wherein said electrode has a main longitudinal axis, the interior surface region of said apex portion being disposed at an angle $a_1$ with respect to said longitudinal axis and the interior surface of said base portion being disposed at an angle $a_2$ with respect to a reference line that is parallel to said longitudinal axis, where $a_2 > a_1$, wherein said directing means generates a converging annular beam of electrons, said annular beam having a cross-over region within the interior of said electrode, wherein the diameter of the base opening of the conical apex portion of said electrode is at least equal to the diameter of the electron beam at its cross-over region, and wherein the diameter of the base opening of the conical base portion is sufficiently large to allow substantially all of the converging annular beam to enter the interior of the electrode without impacting the interior surface of said conical base portion thereof.

9. A system as in claim 8 further including a window member interposed between said electrode and said mask member, and wherein a wafer member coated with a resist material is positioned in a spaced-apart relationship with respect to said mask member.

10. A system as in claim 9 wherein the interior surface region of said apex portion is made of a material that upon impact by electrons emits X-rays whose wavelength is within the passband of said window and within the sensitivity range of said resist material.

11. A system as in claim 10 wherein the interior surface of said conical base portion is made of a material that upon impact by electrons emits X-rays whose wavelength is outside the passband of said window.

12. A system as in claim 10 wherein the interior surface of said conical base portion is made of a material that upon impact by electrons emits X-rays whose wavelength is outside the sensitivity range of said resist material.

13. An X-ray lithographic system for irradiating a mask member that is registered in a spaced-apart relationship with respect to a wafer member coated with a resist material, said system comprising a conical target electrode having an interior inclined surface comprising a conical apex portion and a conical base portion, and means for directing substantially the entirety of a beam of electrons at said interior surface of said apex portion to produce X-ray emission therefrom, wherein the improvement resides in that the material of the interior surface of said apex portion is selected to provide, in response to electron bombardment thereof, X-rays whose wavelength propagates through said system with relatively little attenuation to impinge upon said resist material within the sensitivity range of said material, and wherein the material of the interior surface of said conical base portion is selected to insure that only a relatively low intensity of any X-rays emitted therefrom in the direction of said wafer member propagate through said system and impinge upon said resist material within the sensitivity range of said material.

* * * * *